US007775840B2

(12) United States Patent
Matsumoto et al.

(10) Patent No.: US 7,775,840 B2
(45) Date of Patent: Aug. 17, 2010

(54) FEMALE CONNECTOR TERMINAL WITH INTERNAL PLATE SPRING

(75) Inventors: Katsunari Matsumoto, Nishikamo-gun (JP); Kei Fujimoto, Makinohara (JP)

(73) Assignees: Toyota Jidosha Kabushiki Kaisha, Toyota (JP); Yazaki Corporation, Tokyo (JP)

( * ) Notice: Subject to any disclaimer, the term of this patent is extended or adjusted under 35 U.S.C. 154(b) by 0 days.

(21) Appl. No.: 12/085,034

(22) PCT Filed: Nov. 30, 2006

(86) PCT No.: PCT/JP2006/324397

§ 371 (c)(1),
(2), (4) Date: May 15, 2008

(87) PCT Pub. No.: WO2007/066701

PCT Pub. Date: Jun. 14, 2007

(65) Prior Publication Data

US 2009/0029605 A1 Jan. 29, 2009

(30) Foreign Application Priority Data

Dec. 6, 2005 (JP) ..... 2005-351505

(51) Int. Cl.
*H01R 13/187* (2006.01)

(52) U.S. Cl. ..... 439/843; 439/852

(58) Field of Classification Search ..... 439/843, 439/850, 852

See application file for complete search history.

(56) References Cited

U.S. PATENT DOCUMENTS 3,660,806 A 5/1972 De Stephen
3,842,391 A 10/1974 Dechelette
4,560,231 A 12/1985 Shirai
4,717,356 A * 1/1988 Rahrig et al. ..... 439/464
4,764,133 A * 8/1988 Kaneko ..... 439/889
5,261,840 A 11/1993 Benz
5,281,178 A * 1/1994 Biscorner ..... 439/845
5,649,842 A * 7/1997 Ohsumi ..... 439/858
6,171,155 B1 * 1/2001 Miwa et al. ..... 439/852

FOREIGN PATENT DOCUMENTS

JP A-49-59991 6/1974

(Continued)

OTHER PUBLICATIONS

Dec. 4, 2009 Office Action issued in Chinese Patent Application No. 2006800454169 (with translation).

*Primary Examiner*—Edwin A. Leon
*Assistant Examiner*—Vanessa Girardi
(74) *Attorney, Agent, or Firm*—Oliff & Berridge, PLC

(57) ABSTRACT

A female connector terminal into which a rectangular male connector terminal is to be inserted includes a hollow conductor having a rectangular engagement portion for inserting the male connector terminal; a protrusion arranged at the engagement portion of the conductor and brought into contact with the male connector terminal; and a plate spring arranged at the conductor engagement portion to face the protrusion so as to sandwich the male connector terminal together with the protrusion. The plate spring has an abutment portion formed by bending a plate member and is brought into abutment with both sides of the male connector terminal contact surface which is brought into contact with the plate spring.

4 Claims, 4 Drawing Sheets

FOREIGN PATENT DOCUMENTS

| | | | | |
|---|---|---|---|---|
| JP | B2-51-19583 | | | 6/1976 |
| JP | U-52-40383 | | | 3/1977 |
| JP | U-52-40384 | | | 3/1977 |
| JP | A-62-243265 | | | 10/1987 |
| JP | A-8-78081 | | | 3/1996 |
| JP | A-11-297392 | | | 10/1999 |
| JP | 2007-141703 | A | * | 6/2007 |
| JP | 2007-157515 | A | * | 6/2007 |

* cited by examiner

FEMALE CONNECTOR TERMINAL WITH INTERNAL PLATE SPRING

TECHNICAL FIELD

The present invention relates to a female connector terminal and a female connector, and more particularly to a female connector terminal into which a rectangular male connector terminal can be inserted, and to a related female connector.

BACKGROUND ART

The electrical systems in automotive vehicles include connectors (e.g., high-voltage connectors) which are electrically connected by inserting a male connector into a female connector. In general, a male connector includes a male connector terminal and a female connector includes a female connector terminal.

FIG. 4 illustrates a coupled state of a male connector terminal and a conventional female connector terminal, in which FIG. 4(A) illustrates a cross-sectional view taken along a plane in an insertion direction of the male connector terminal and FIG. 4(B) illustrates a cross-sectional view taken along a plane in a direction normal to the insertion direction of the male connector terminal.

A female connector terminal 50 includes a conductive portion 54, ribs 56, and an elastic member 58. The ribs 56 can contact a conductive surface of the male connector terminal 52 when the male connector terminal 52 is coupled with the female connector terminal 50. The elastic member 58 faces the ribs 56. The conductive surface of the male connector terminal 52 is a surface on which a metal plating (e.g., tinning) is applied. A clearance is provided between the ribs 56 and the elastic member 58 to support the male connector terminal 52. If the conductive surface of the male connector terminal 52 contacts the ribs 56 of the female connector terminal 50, an electric path connecting the male connector terminal 52 and the female connector terminal 50 can be formed.

As discussed in Japanese Laid-Open Patent Application No. Hei 8-78081, if a female connector terminal includes an elastic member (e.g., a plate spring), a specific portion of the female connector terminal is not worn excessively when the male connector terminal is frequently inserted and disengaged. The female connector terminal can provide superior insertion/disengagement durability.

However, if a female connector has such a above-described female connector terminal, the pressing force exerted on the male connector terminal is applied only in the up-and-down direction. Therefore, a small sideways sliding movement may occur at a contact portion between the male connector terminal and the female connector terminal when an engine or automotive vehicle body vibrates, or when a thermal expansion or a thermal shrinkage occurs due to temperature changes or the like. In such cases, a small sliding movement at the contact portion between the male connector terminal and the female connector terminal induces friction on the conductive surface of the male connector terminal, i.e., the surface on which the metal plating (e.g., tinning) has been applied, and forms a metal oxide (e.g., tin oxide) on the conductive surface.

As described above, if a metal oxide is formed on the conductive surface of the male connector terminal, the formed metal oxide increases the contact resistance at the contact portion between the male connector terminal and the female connector terminal, and may possibly also increase the temperature at the contact portion.

Generally, the substrate of the female connector holding the female connector terminal is made of a synthetic resin material having appropriate insulation properties. Therefore, if the temperature at the contact portion between the male connector terminal and the female connector terminal increases excessively, the synthetic resin material may soften leading to damage of the female connector.

If the connector is a high-voltage type subjected to large current, the board thickness of its male connector terminal is thick and the rigidity of its male connector terminal is high. Therefore, to reduce an insertion load required when the male connector terminal is inserted into the female connector terminal, a predetermined clearance is required between both edges of the male connector terminal and an inner surface of the female connector terminal.

Hence, an object of the present invention is to provide a female connector terminal and a female connector that can suppress a slide movement of a male connector terminal relative to a female connector terminal and can reduce the contact resistance at a contact portion between the male connector terminal and the female connector terminal.

DISCLOSURE OF INVENTION

A female connector terminal according to the present invention is a female connector terminal into which a rectangular male connector terminal can be inserted, including a hollow conductor having a rectangular engagement portion capable of receiving the inserted male connector terminal; a protrusion disposed at the engagement portion of the conductor and brought into contact with the inserted male connector terminal; and a plate spring disposed at the conductor engagement portion to face the protrusion so that the inserted male connector terminal can be sandwiched between the plate spring and the protrusion, wherein the plate spring includes an abutment portion configured into a predetermined shape by bending a plate member and brought into abutment with both sides of a contact surface of the male connector terminal which contact the plate spring, and a plurality of fins aligned in a direction normal to an insertion direction of the male connector terminal and supporting the contact surface of the male connector terminal, thereby suppressing a slide movement of the male connector terminal relative to the female connector terminal.

Furthermore, according to the female connector terminal of the present invention, it is preferable that the abutment portion is formed by bending one plate member in a direction opposed to a bending direction of the other plate member.

Moreover, according to the female connector terminal of the present invention, it is preferable that the abutment portion has peripheral edges brought into contact with both side surfaces of the engagement portion.

A female connector according to the present invention includes a female connector terminal into which a rectangular male connector terminal can be inserted, the female connector terminal including a hollow conductor having a rectangular engagement portion capable of receiving the inserted male connector terminal; a protrusion disposed at the engagement portion of the conductor and brought into contact with the inserted male connector terminal; and a plate spring disposed at the conductor engagement portion to face the protrusion so that the inserted male connector terminal can be sandwiched between the plate spring and the protrusion, wherein the plate spring includes an abutment portion configured into a predetermined shape by bending a plate member and brought into abutment with both sides of a contact surface of the male connector terminal which contacts the plate spring, and a plurality of fins aligned in a direction normal to an insertion direction of the male connector terminal and supporting the contact surface of the male connector terminal, thereby suppressing a slide movement of the male connector terminal relative to the female connector terminal.

The above-described female connector terminal and the female connector can suppress sliding movement of the male connector terminal relative to the female connector terminal and can reduce the contact resistance at a contact portion between the male connector terminal and the female connector terminal.

BEST MODE FOR CARRYING OUT THE INVENTION

Figure 1:
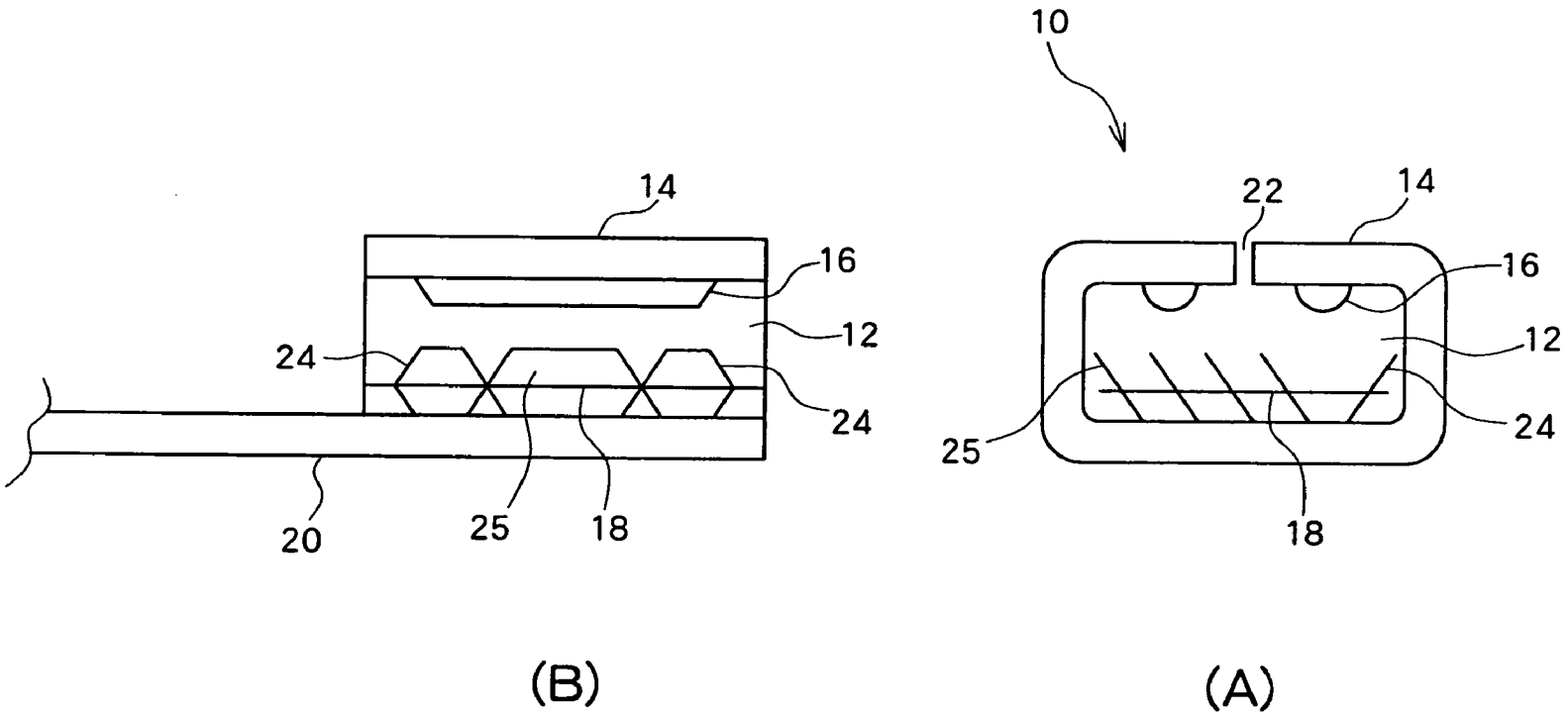
FIG. 1 illustrates an arrangement of a female connector terminal according to an embodiment of the present invention.

An embodiment of the present invention is described in detail below with reference to attached drawings. FIG. 1 illustrates an arrangement of a female connector terminal, in which FIG. 1(A) illustrates a cross-sectional view of the male connector terminal taken along a plane in an insertion direction and FIG. 1(B) illustrates a cross-sectional view of the male connector terminal taken along a plane in a direction normal to the insertion direction.

A female connector terminal 10 includes a hollow conductor 14 having a rectangular engagement portion 12 into which a rectangular male connector terminal can be inserted. The female connector terminal 10 includes protrusions 16 disposed at the engagement portion 12 of the conductor 14 so that the inserted male connector terminal can be brought into contact with the protrusions 16. The female connector terminal 10 includes a plate spring 18 disposed at the engagement portion 12 of the conductor 14 so as to face the protrusions 16. The inserted male connector terminal can be sandwiched between the protrusions 16 and the plate spring 18.

The conductor 14, disposed on a substrate 20 of the female connector terminal 10, has a hollow shape into which a male connector terminal having a rectangular cross section can be inserted. The conductor 14 includes the engagement portion 12 having a rectangular cross section so that a rectangular male connector terminal can be inserted. The engagement portion 12 has a size sufficiently larger than a size of an outer shape of the male connector terminal to be inserted. Furthermore, to facilitate insertion of the male connector terminal, the conductor 14 includes a slit 22 so that the conductor 14 can easily expand outward when the male connector terminal is inserted into the engagement portion 12.

Generally, the conductor 14 is made of a metallic material (e.g., copper or aluminum), although it is obvious that the conductor 14 is not limited to a metallic material and can be made of any other conductive material that satisfies determined conditions. The formation of the conductor 14 includes press-processing or cut-processing a metallic thin plate into a predetermined shape, forming a pre-stage component, and bend-processing the pre-stage component to have a rectangular cross section. Obviously, the conductor formation method is not limited to the above-described example and any other method of formation method that satisfies the determined requirements can be used. Then, the conductor 14 and the substrate 20 of the female connector terminal 10 are fixed together, for example, using an adhesive.

The protrusions 16, disposed on an inner wall surface of the engagement portion 12 of the conductor 14, have a function of forming an electric path connecting the male connector terminal and the female connector terminal 10 when the protrusions 16 contact the male connector terminal. Then, the protrusions 16 can be disposed at both sides of the slit 22 of the conductor 14. The protrusions 16 have a semicircular cross-sectional shape in the insertion direction of the male connector terminal. Obviously, the layout and the cross-sectional shape of the protrusions 16 are not limited to the above-described example and can be modified in various ways as long as the predetermined conditions are satisfied.

In general, the protrusions 16 are made of a metallic material (e.g., copper or aluminum). Obviously, the protrusions 16 are not limited to a metallic material and can be made of any other conductive material if predetermined conditions are satisfied. In general, the formation of the protrusions 16 includes press-processing or cut-processing a metallic material into a predetermined shape. The protrusions 16 and the conductor 14 are fixed together using, for example, welding or adhesive bonding. Obviously, the protrusions 16 can be integrally formed with the conductor 14 if predetermined conditions are satisfied.

The plate spring 18 is disposed at the engagement portion 12 of the conductor 14 to face the protrusions 16. The plate spring 18 and the protrusions 16 can support a male connector terminal sandwiched therebetween. The plate spring 18 has abutment portions 24 and 25 which are brought into abutment with both sides of a contact surface of the male connector terminal. The abutment portions 24 and 25 have a shape formed by bending a plate member.

Figure 2A:
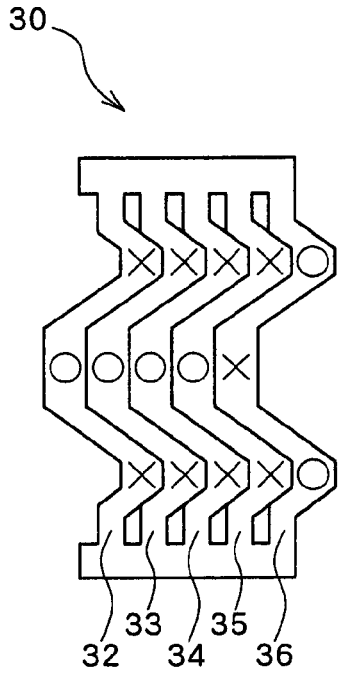
FIG. 2A illustrates a method for forming a plate spring according to an embodiment of the present invention.
Figure 2B:
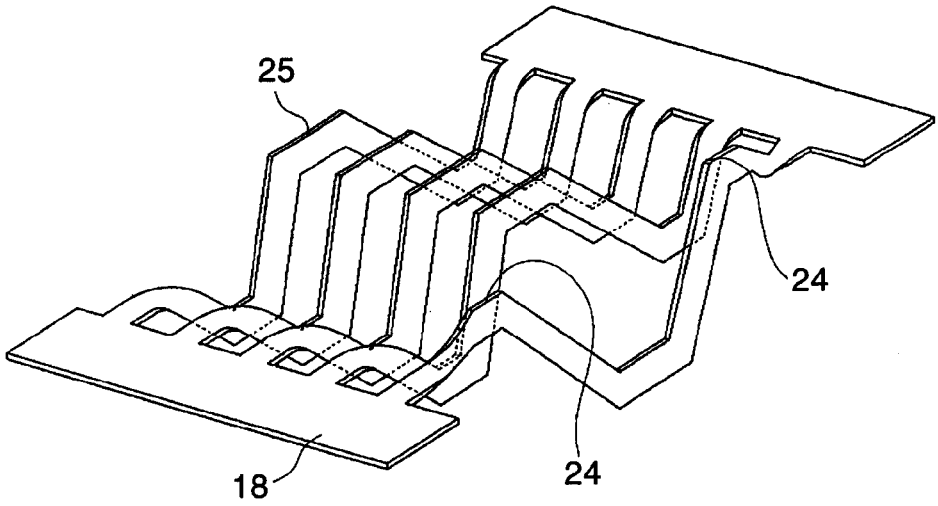
FIG. 2B illustrates an isometric view of the plate spring in its final form after a semi-finished plate spring of FIG. 2A is bent.

In general, the plate spring 18 is made of a metallic material (e.g., copper or aluminum). FIGS. 2A and 2B illustrate a method for forming the plate spring 18 according to an embodiment of the present invention. The plate spring forming method includes punching a thin metallic plate into a predetermined shape by press to form a semi-finished plate spring 30 illustrated in FIG. 2A, which includes five fins 32 to 36 that form the plate spring 18. Obviously, the number of the fins is not limited to a specific value (e.g., five according to this embodiment). The plate spring forming method further includes bending the semi-finished plate spring 30 into a final shape of the plate spring 18.

The plate spring forming method includes bending outermost fins 32 and 36 of the above-described five fins 32 to 36 to extend in mutually opposed directions. That is, the bending direction of one end fin 32 is opposed to the bending direction of the other fin 36, so that the abutment portions 24 and 25 of the plate spring 18 are brought into abutment with both sides of the contact surface of the male connector terminal which contacts the plate spring.

For example, the plate spring forming method includes bend processing a portion indicated by a mark O forward relative to the drawing surface and bend processing a portion indicated by a mark X backward relative to the drawing surface in respective fins 32 to 36 illustrated in FIG. 2A.

As described above, a plate member having one abutment portion 24 inclines in a direction opposed to a direction of a plate member having the other abutment portion 25. Furthermore, the intermediate fins 33, 34, and 35 disposed between the outermost fins 32 and 36 incline in a direction similar to the inclined direction of the fin 32 (i.e., one of the outermost fins 32 and 36). Bending the semi-finished plate spring 30 as described above may form the plate spring 18, as shown in FIG. 1 and FIG. 2B.

Figure 3:
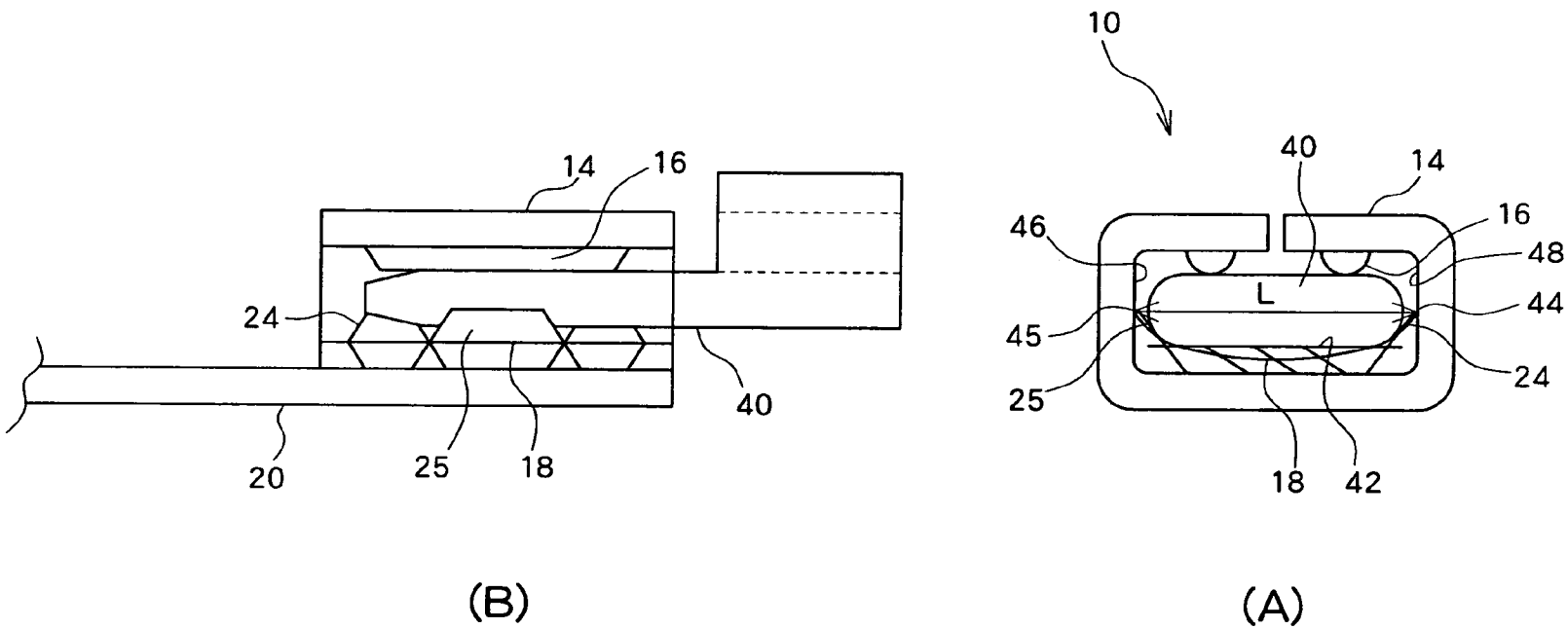
FIG. 3 illustrates a coupled state of a male connector terminal and a female connector terminal according to an embodiment of the present invention.
Figure 4:
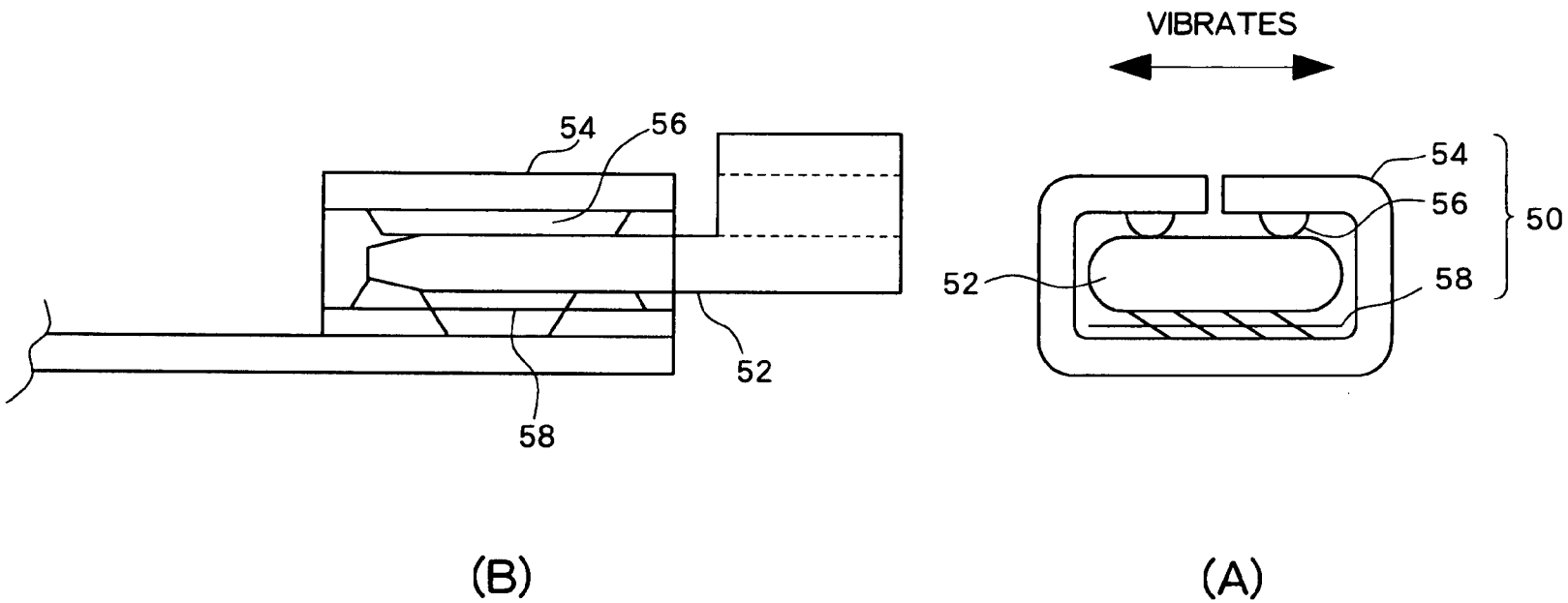
Fig. 4 RELATED ART
FIG. 4 illustrates a coupled state of a male connector terminal and a conventional female connector terminal.

FIG. 3 illustrates a coupled state of a male connector terminal and a female connector terminal, in which FIG. 3(A) illustrates a cross-sectional view taken along a plane in an insertion direction of the male connector terminal and FIG. 3(B) illustrates a cross-sectional view taken along a plane in a direction normal to the insertion direction of the male connector terminal.

The abutment portions 24 and 25 positioned at both sides of the plate spring 18 have a size and a bending angle that can suppress a slide movement of the male connector terminal 40 relative to the female connector terminal 10 in a direction normal to the insertion direction of the male connector terminal 40. More specifically, a width L between a peripheral edge 44 of one end abutment portion 24 and a peripheral edge 45 of the other end abutment portion 25 is set to be greater than a width between both sides (R-portion) of a contact surface 42 of the male connector terminal 40.

Furthermore, in determining the size and the bending angle of the abutment portions 24 and 25 of the plate spring 18, it is preferable that the peripheral edges 44 and 45 of the abutment portions 24 and 25 provided at both edges of the plate spring 18 can abut both side surfaces 46 and 48 of the engagement portion 12 when the male connector terminal 40 is inserted into the female connector terminal 10.

The arrangement that the peripheral edges 44 and 45 of the abutment portions 24 and 25 are brought into contact with the side surfaces 46 and 48 of the engagement portion 12 can enhance a force for suppressing a slide movement of the male connector terminal 40 relative to the female connector terminal 10 in a direction normal to the insertion direction of the male connector terminal 40.

A function of the female connector terminal 10 is described below. If the male connector terminal 40 is inserted into the engagement portion 12 of the conductor 14 in the female connector terminal 10, the plate spring 18 elastically deforms in the conductor 14. The protrusions 16 and the plate spring 18 can press the male connector terminal 40 in the up-and-down direction, because the protrusions 16 and the plate spring 18 oppose each other in the up-and-down direction of the male connector terminal 40. The abutment portions 24 and 25 of the plate spring 18 press the male connector terminal 40 in the direction normal to the insertion direction of the male connector terminal 40, because the abutment portions 24 and 25 can abut both sides of the contact surface 42 of the male connector terminal 40.

Furthermore, in the direction normal to the insertion direction of the male connector terminal 40, the peripheral edges 44 and 45 of the abutment portions 24 and 25 of the plate spring 18 can abut the side surfaces 46 and 48 of the engagement portion 12 of the conductor 14 to surely press the male connector terminal 40.

Accordingly, the above-described female connector terminal and the female connector can suppress a slide movement of the male connector terminal relative to the female connector terminal and can reduce the contact resistance at the contact portion between the male connector terminal and the female connector terminal and can reduce heat generation caused by friction.

Furthermore, the above-described female connector terminal and the female connector can provide a predetermined clearance between both edges of the male connector terminal and the inner surface of the female connector terminal. This makes it possible to decrease an insertion load required when the male connector terminal is inserted into the female connector terminal.

Moreover, the above-described female connector terminal and the female connector can improve a self alignment function in a process of inserting the male connector terminal and therefore can prevent the inserted male connector terminal from slanting, and prevent the contact resistance from increasing due to one end contact.

The invention claimed is:

1. A female connector terminal into which a rectangular male connector terminal can be inserted, comprising:

a hollow conductor having a rectangular engagement portion capable of receiving the inserted male connector terminal, the inserted male connector terminal comprising two sides of a contact surface facing in a direction parallel to an insertion direction of the inserted male connector terminal;

a protrusion disposed at the engagement portion of the conductor and brought into contact with the inserted male connector terminal; and a plate spring disposed at the conductor engagement portion to face the protrusion so that the inserted male connector terminal can be sandwiched between the plate spring and the protrusion, wherein the plate spring comprises at least two plate members which form abutment portions configured into a predetermined shape by bending plate members and brought into abutment with the two sides of the contact surface of the male connector terminal, and a plurality of fins aligned in a direction normal to an insertion direction of the male connector terminal bent in a direction similar to the bending of the plate members and support the contact surface of the male connector terminal, thereby suppressing a slide movement of the male connector terminal relative to the female connector terminal in the direction normal to the insertion direction of the inserted male connector terminal.

2. The female connector terminal according to claim 1, wherein each abutment portion is formed by bending one plate member in a direction opposed to a bending direction of a second plate member.

3. The female connector terminal according to claim 1, wherein each abutment portion has a peripheral edge brought into contact with one of two side surfaces of the engagement portion.

4. A female connector comprising the female connector terminal according to claim 1.

* * * * *